US008809710B2

(12) United States Patent
Ulomek

(10) Patent No.: US 8,809,710 B2
(45) Date of Patent: Aug. 19, 2014

(54) ACTUATION UNIT

(75) Inventor: Peter Ulomek, Radevormwald (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 424 days.

(21) Appl. No.: 13/121,619

(22) PCT Filed: Sep. 29, 2009

(86) PCT No.: PCT/EP2009/062641

§ 371 (c)(1),
(2), (4) Date: Jun. 10, 2011

(87) PCT Pub. No.: WO2010/037757

PCT Pub. Date: Apr. 8, 2010

(65) Prior Publication Data

US 2011/0278144 A1 Nov. 17, 2011

(30) Foreign Application Priority Data

Sep. 30, 2008 (DE) ..... 10 2008 049 580
Jul. 15, 2009 (DE) ..... 10 2009 033 486

(51) Int. Cl.
*H01H 9/04* (2006.01)
*H01H 19/06* (2006.01)

(52) U.S. Cl.
USPC ..... 200/302.3; 200/302.1

(58) Field of Classification Search
CPC ..... H01H 13/06; H01H 9/14
USPC ..... 200/302.2, 302.3
See application file for complete search history.

(56) References Cited

U.S. PATENT DOCUMENTS 3,036,171 A * 5/1962 Wiley ..... 200/409
4,739,127 A * 4/1988 Higuchi et al. ..... 200/5 R (Continued)

FOREIGN PATENT DOCUMENTS

DE 19856902 A1 6/2000
DE 202004014569 U1 2/2005

(Continued)

OTHER PUBLICATIONS

International Search Report in German, mailing date Nov. 17, 2009, for corresponding International Application No. PCT/EP2009/062641 and an English translation.

(Continued)

*Primary Examiner* — Renee Luebke
*Assistant Examiner* — Ahmed Saeed
(74) *Attorney, Agent, or Firm* — Intellectual Property Law Group LLP

(57) ABSTRACT

The invention relates to an actuation unit of a moving part (1) of a motor vehicle, in particular a rear hood (1), comprising an actuation part (10) that is fastened to a housing part (20), at least two conductor elements (21) disposed on the housing part (20), an elastically deformable contact element (22) that cooperates with the conductor elements (21), a plunger (11), which is disposed at the actuation part (10), for deforming the contact element (22). According to the invention, the actuation part (10) and the housing part (20) delimit an internal space (2) that is totally closed off from the environment (3), and the actuation part (10) is mounted pivotably about an axis (4) that runs axisymetrically with respect to the internal space (2).

21 Claims, 5 Drawing Sheets

(56) References Cited

U.S. PATENT DOCUMENTS

Figure 1:
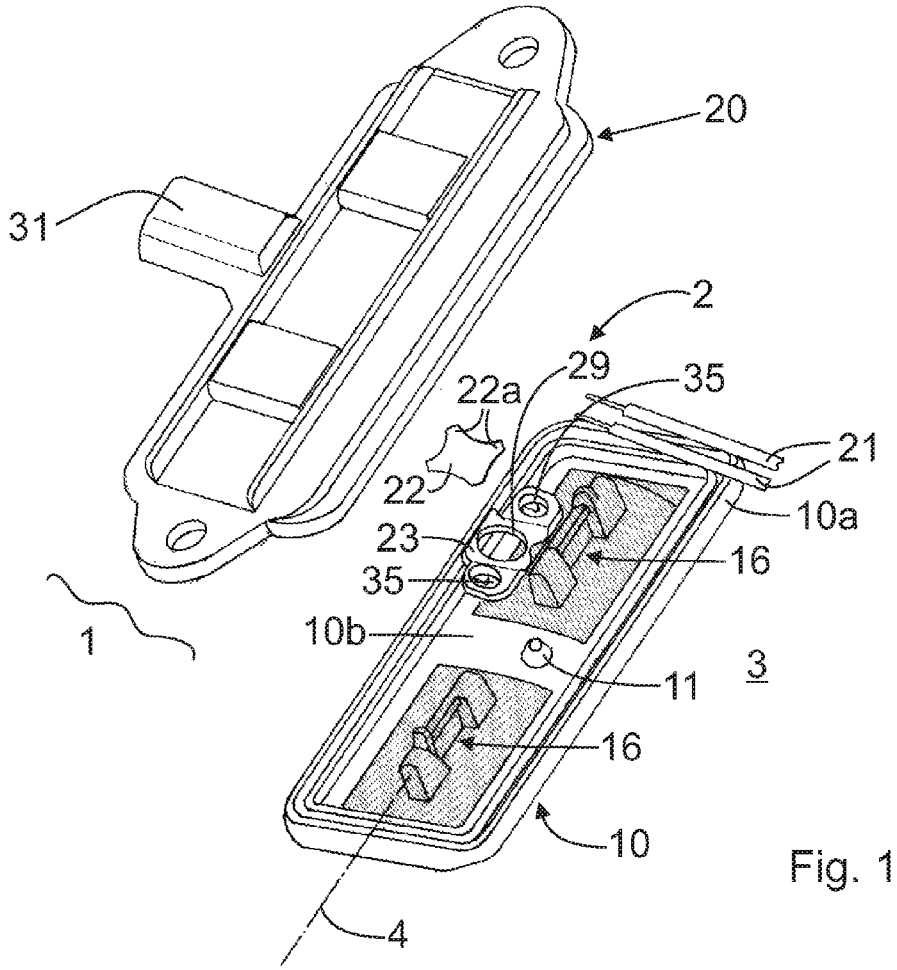

| | | | | |
|---|---|---|---|---|
| 6,559,398 | B2 * | 5/2003 | Takeda et al. | 200/339 |
| 6,936,777 | B1 * | 8/2005 | Kawakubo | 200/1 B |
| 7,884,293 | B2 * | 2/2011 | Ulomek | 200/61.76 |
| 2007/0021721 | A1 * | 1/2007 | Lopez | 604/249 |

FOREIGN PATENT DOCUMENTS

| | | | |
|---|---|---|---|
| DE | 102005034763 | B3 | 9/2006 |
| DE | 102006024292 | A1 | 11/2007 |
| EP | 1803595 | A1 | 7/2007 |
| GB | 2229577 | A | 9/1990 |
| WO | WO 2007134663 | A1 | 11/2007 |

OTHER PUBLICATIONS

Written Opinion in German, for corresponding International Application No. PCT/EP2009/062641.

* cited by examiner

VIII - VIII

ACTUATION UNIT

CROSS-REFERENCE TO RELATED APPLICATIONS

This application is a U.S. National Phase application, under 35 U.S.C. §371, of International Application no. PCT/EP2009/062641, with an international filing date of Sep. 29, 2009, and claims benefit of German Application no. 102008049580.8 filed on Sep. 30, 2008 and German Application no. 102009033486.6 filed on Jul. 15, 2009, and which are hereby incorporated by reference for all purposes.

The invention relates to an actuation unit of a movable part of a motor vehicle, in particular a rear hood, comprising an actuation part which is fastened to a housing part, at least two conductor elements which are arranged on the housing part, an elastically deformable contact element which cooperates with the conductor elements, and a plunger which is arranged on the actuation part for deforming the contact element.

An actuation unit comprising a movable actuation part which is fastened to a fixed housing part is disclosed in DE 10 2005 034 763 B3. With a manual activation of the actuation part a contact element which is arranged inside the actuation unit and which is a component of an electric switch is brought into contact and/or deformed, as a result of which the conductor elements are short-circuited by the contact between the deformed contact element and the conductor elements. As a result, a signal may be produced, for example, which leaves the actuation unit in order to activate, for example, an electric drive which, for example, is provided on a closing device of the rear hood. In order to protect the electrical components from moisture, and thus from corrosion, said components are generally enclosed by a sealing compound. The moisture enters the internal space, for example, via a ventilation hole provided in the actuation unit. Said ventilation holes are generally arranged on the housing part and connect the external region of the actuation unit to the internal space of the actuation unit which is defined by the actuation part and the housing part in order to permit a volume displaced by the actuation part to escape.

The object of the present invention is to provide an actuation unit of a movable part of a motor vehicle which is designed so that production which is markedly more rapid and more cost-effective may be achieved with good functional properties.

This object is achieved by proposing an actuation unit having the features of claim 1. Preferred developments are set forth in the dependent claims.

To this end, according to the invention it is provided that the actuation part and the housing part define an internal space which is entirely sealed off from the environment, and the actuation part is pivotably mounted about an axis which extends axially symmetrically relative to the internal space. The essential idea of the invention is to simplify the construction of the electrical components within the actuation unit. With manual actuation, the actuation part is moved axially symmetrically relative to the internal space of the actuation unit so that a compensation of the pressure in the internal space is not required. As the actuation part is mounted axially symmetrically relative to the internal space and pivotably about the axis, air does not have to be displaced from the internal space of the actuation unit in any position of the actuation part. For this reason, the arrangement of complicated ventilation holes is not necessary. Thus the actuation part and the housing part may be entirely sealed off, in particular screened off, from the environment whereby dirt or moisture, for example, are not able to penetrate the internal space. Thus the electronics in the internal space of the actuation unit are protected, whereby the service life of the device according to the invention and its functional properties may be substantially increased. As a result, in the present invention, it is possible to dispense with enclosing the conductor elements and/or the elastically deformable contact element expensively with sealing compound, resin or the like in a watertight manner, as the actuation unit according to the invention, in particular its internal space, is entirely sealed off from the environment.

In one possible embodiment of the invention a retaining element is fastened to the housing part such that at the same time the contact element is reliably held in position. Thus the contact element may be reliably held in its position on the housing part via a retaining element which is structurally less complicated. It is also conceivable that the contact element is directly fastened to the housing part, without the retaining element.

The conductor elements advantageously extend through the wall of the housing part and are connected to an electrical plug. Said plug may in this case be a sealed plug, whereby the internal space is completely sealed from the exterior. Moreover, it is conceivable that the conductor elements are at least partially provided with a sealing compound or bonding agent, in particular where the conductor elements leave the internal space of the actuation unit. As a result, it is also possible for the internal space to be reliably sealed off.

In one possible embodiment of the invention, the actuation part and the housing part are connected together by a material connection on their peripheral edge regions. In this case, it is conceivable that the edge regions of the actuation part and of the housing part are laser-welded to one another. Also, further material connections are conceivable, such as for example a bonded connection.

Expediently, the axis about which the actuation part is pivotable in an axially symmetrical manner relative to the internal space extends inside the internal space. To this end, corresponding mountings may be provided, for example, in the internal space of the actuation unit, on which the actuation part moves in the event of manual activation, and thus triggers a corresponding signal via the activation of the contact element. The structure of the actuation unit may also be designed so that the pivot axis, about which the actuation part rotates in an axially symmetrical manner relative to the internal space, extends outside the internal space. To this end, corresponding bearing points may be provided which ensure an axially symmetrical movement relative to the internal space during the activation of the actuation part.

In one possible embodiment of the actuation unit, the housing part comprises a contoured body to which the retaining element or the contact element is fastened. The contoured body may, for example, extend as a type of platform from the housing part in the direction of the housing part. In order to simplify the mounting of the contact element, the retaining element or the contact element is fastened positively and/or non-positively to the contoured body. For example, in this case a latching connection or clip connection may be provided, which holds the contact element reliably between the retaining element and the conductor elements. Advantageously, it is provided that the contoured body is designed with at least one fixing element to which the retaining element or the contact element is fastened.

Advantageously, the housing part is configured with channels which are open on one side, in which one respective conductor element extends. The open channels are guide tracks in order to position the conductor element reliably in the housing element during mounting. In this case, the channels advantageously extend parallel to one another. The open channels extend in the direction of a sleeve element formed on the housing part, in which the conductor elements terminate. The sleeve element has in this case the function of an electrical plug which may be connected to electrical components provided outside the actuation unit.

The conductor elements may be designed at least partially with a surface which is of tooth-like configuration and which acts on the housing part, whereby a reliable fixing of the conductor element inside the internal space of the actuation unit may be achieved. The conductor element may in this case comprise one or more toothed portions, which during assembly penetrate the material of the housing part at least on its surface and thus provide a reliable fixing of the conductor element within the open channel. As a result, during overall assembly of the actuation unit the conductor element is prevented from being inadvertently released from the channel by possible vibrations of the actuation unit.

Expediently, the conductor element has at least one projection-like stop means, such that an inadvertent removal of the conductor element from the internal space is prevented. In this case it is conceivable that the conductor element may be inadvertently pulled out of the actuation unit via a corresponding tensile force at the free end of the conductor element inside the sleeve element. The stop means, which for example is arranged transversely to the extension of the rod-shaped conductor element, in this case provide sufficient resistance to the material of the housing part.

In a measure improving the invention, the retaining element has a through-opening, so that the contact element may be brought into contact with the plunger. The contact element may, for example, be a curved hard metal plate or snap disk. By a predetermined compressive force of the plunger exerted on the surface which is curved in a concave manner, the contact element is depressed and strikes with its surface, which was initially curved in a convex manner, against the contact surfaces of the conductor elements. Thus the electrical contact is produced between the conductor elements. Advantageously, a restoring force acts on the actuation part which always attempts to move the actuation part back into its initial position, where no electrical contact is present between the conductor elements. For example, the restoring force may originate, amongst other things, from the contact element, or solely from the contact element, which strives, when the actuation force on the actuation part is reduced, to return abruptly into its previously bulged initial position. It is also conceivable that the restoring force is produced via a resilient element, which assists the restoring process of the actuation part. In order to protect the contact element from a force overload, the actuation unit may comprise limiting means which restrict a deflection movement of the actuation part.

In a preferred embodiment of the invention, the actuation part is designed as a multi-component injection-molded part made of plastics material. In this case, the actuation part may consist of a hard component and a flexible component, the edge region of the actuation part which is fastened to the housing part, and the plunger consisting of the flexible component. The central region of the actuation part, however, consists of a hard component, on which latching means are provided which are connected to corresponding counterlatching means on the housing part. In this case, a first latching means may be of shell-like configuration and the second latching means, which is designed as corresponding counterlatching means, may be held by the first latching means. Advantageously, the second latching means has a bearing body which is positively held on the first latching means, the second latching means being rotatably mounted on the first latching means, so that the actuation part may be reliably pivoted when activated by the user. In this case, advantageously, the pivot axis of the actuation part extends through the first and the second latching means. The first latching means may, for example, be arranged on the housing part and the second latching means may, in contrast, be arranged on the actuation part. In order to ensure reliable mounting of the actuation part on the housing part, the latching means of the actuation part and of the housing part consist of the hard component.

By the design of the plunger with the flexible component, a haptic element which is pleasant for the user is produced when the actuation part is activated. Moreover, the effect of the flexible component is that, even with a slightly greater force on the actuation part, a corresponding compensation of the stroke may be achieved via a deformation of the plunger, whereby the risk of damage to the contact element may be reduced. Advantageously, the mechanical resistance of the flexible component is between 30 Shore-A and 70 Shore-A.

In one embodiment it is also conceivable that the contact element is designed with at least one fastening portion with one respective opening, through which the fixing element protrudes. In this embodiment, the contact element is directly connected to the contoured body of the housing part, without a retaining element being necessary. As a result, a further simplification of the entire structure of the actuation unit may be achieved.

Advantageously, the fastening portion in the region of the opening is designed with a wing element which acts on the fixing element, in particular is aligned obliquely to the fixing element, whereby a reliable fastening of the contact element to the housing part is ensured.

Figure 2:
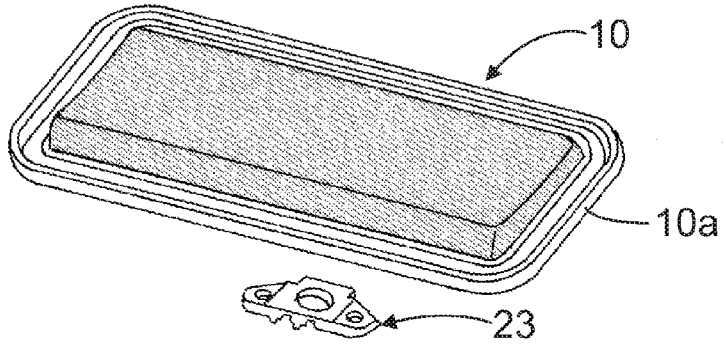
Figure 2:
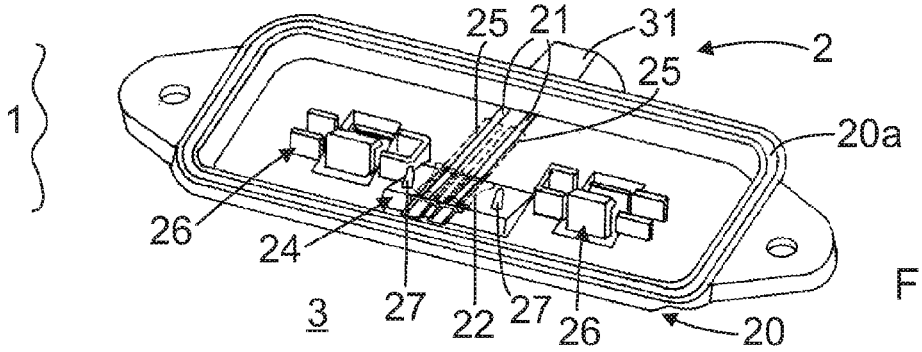
Figure 3:
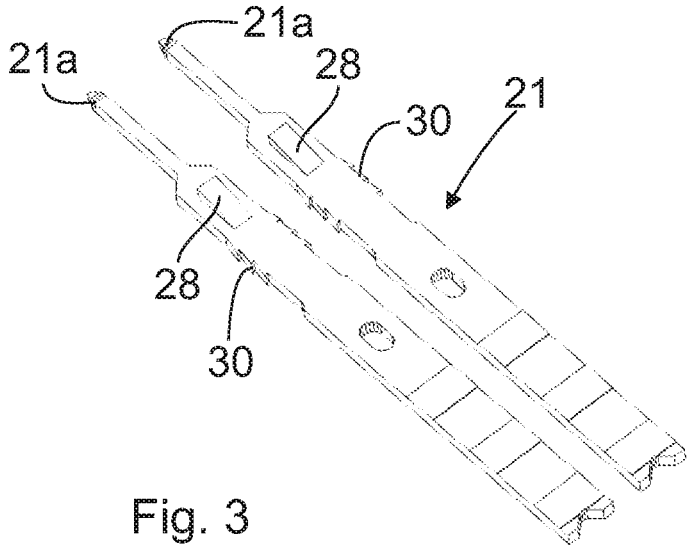
Figure 4:
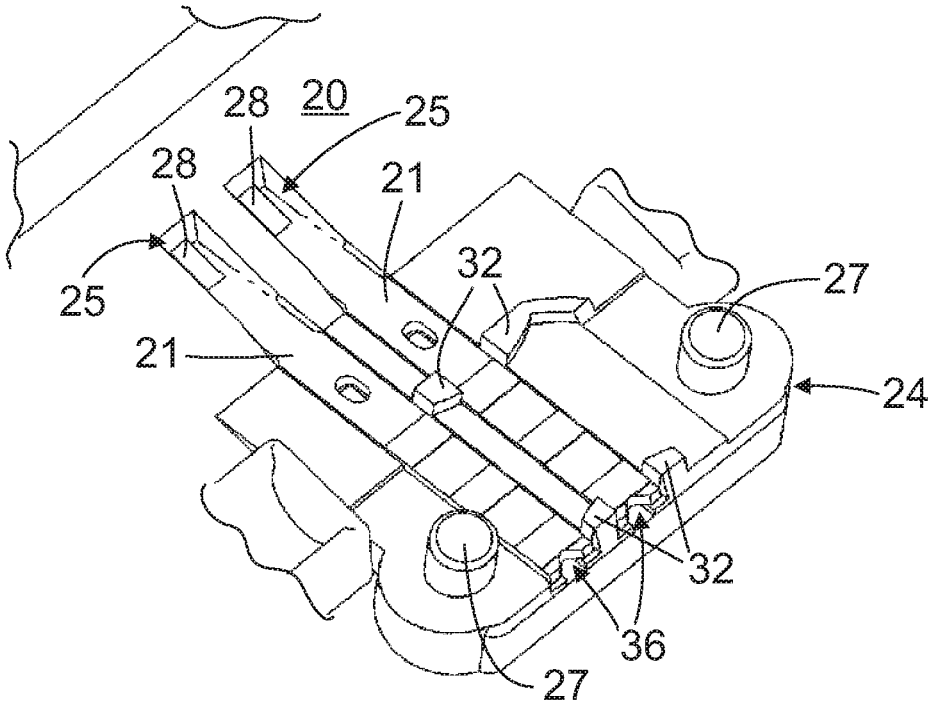
Figure 5:
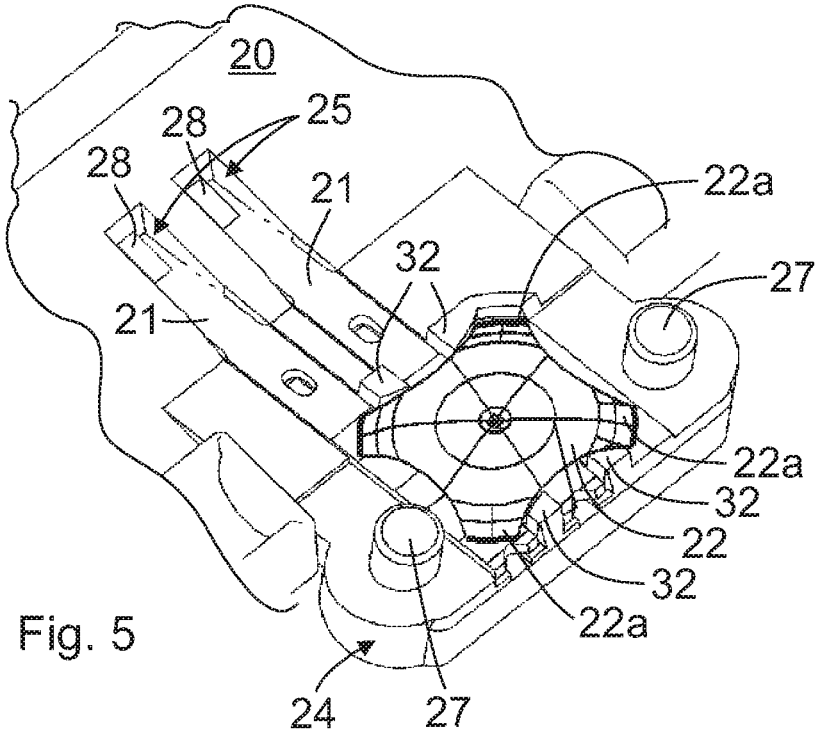
Figure 6:
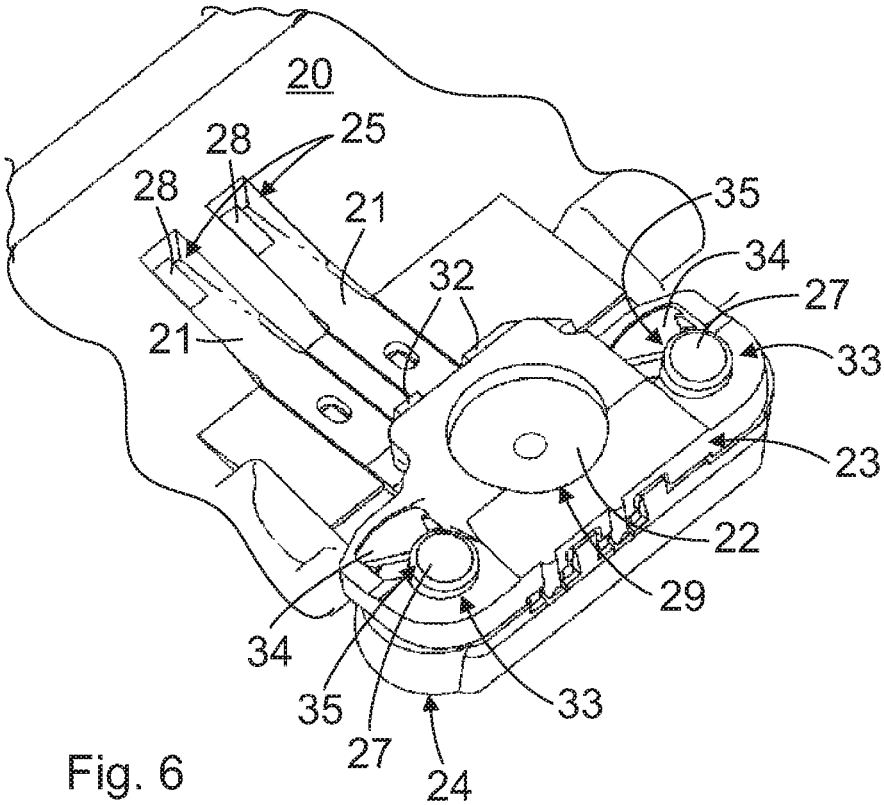
Figure 7:
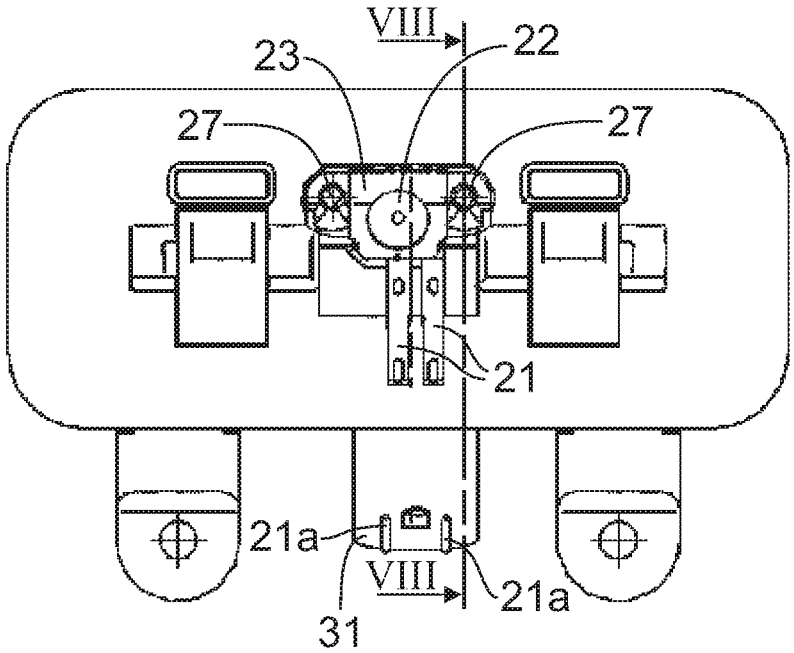
Figure 8:
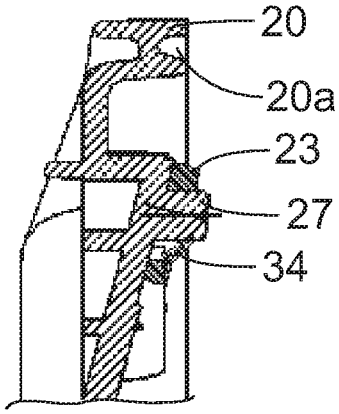
Figure 9:
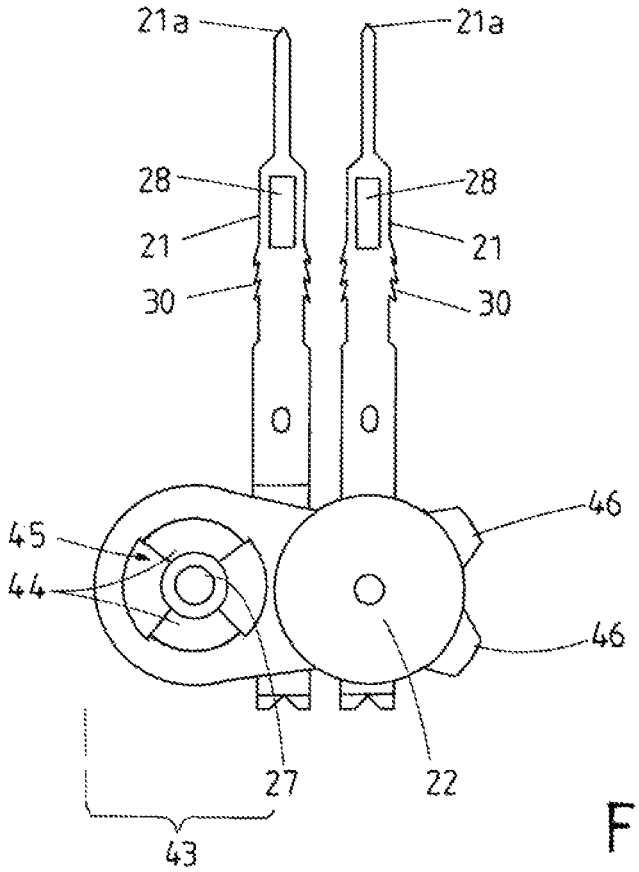
Figure 10:
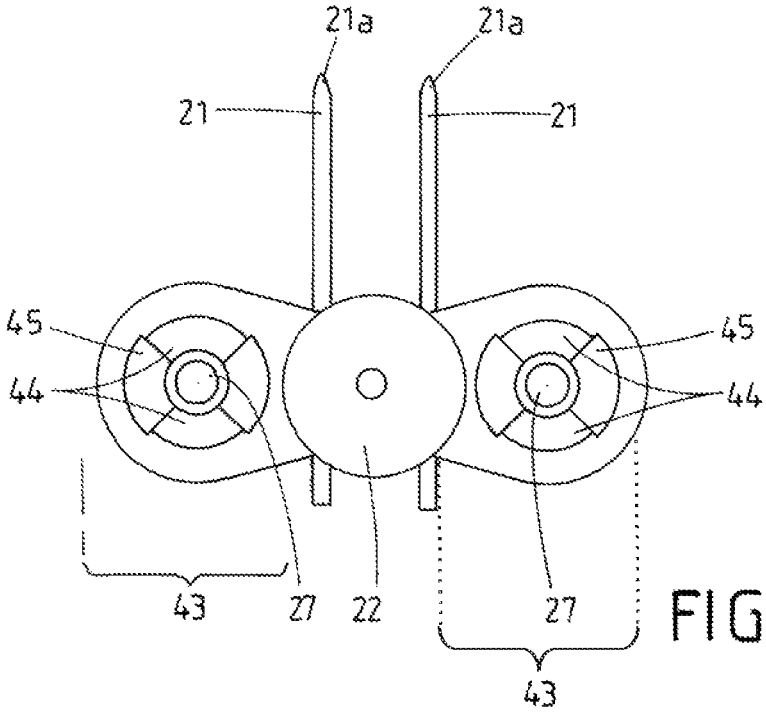

Further advantages, features and details of the invention are revealed from the following description, in which a plurality of exemplary embodiments of the invention are described in detail with reference to the drawings. In this case, the features mentioned in the claims and in the description in each case are essential to the invention, separately per se or in any combination, in which:

FIG. 1 shows a simplified exploded view of a first view of the actuation unit according to the invention, FIG. 2 shows the actuation unit according to FIG. 1 from a second view, FIG. 3 shows a possible variant of two conductor elements which are arranged inside the actuation unit according to FIG. 1, FIG. 4 shows the conductor elements of FIG. 3 which are arranged in the housing part of the actuation unit, FIG. 5 shows a further view of the housing part of the actuation unit, a contact element being positioned on the conductor elements according to FIG. 4, FIG. 6 shows a further view of the housing part of the actuation unit, a retaining element being positioned on the contact element, FIG. 7 shows a side view of the actuation unit, FIG. 8 shows a sectional view along the cutting line VIII-VIII of FIG. 7, FIG. 9 shows a variant of the retaining element and of the contact element and FIG. 10 shows a further embodiment of the retaining element and of the contact element.

FIG. 1 and FIG. 2 show an actuation unit of a movable part 1 of a motor vehicle, which in the present case is a rear hood 1. The rear hood 1 is shown purely schematically in FIGS. 1 and 2. The actuation unit has an actuation part 10 which, in the mounted state of the actuation unit, is fastened to a housing part 20. On the housing part 20 two conductor elements 21 are arranged, on which an elastically deformable contact element 22 made of metal is located. The contact element 22 is simply indicated in FIG. 2 in a dashed-dotted manner. On the actuation part 10 a plunger 11 is provided which, with a manual actuation of the actuation part 10, presses down the contact element 22, whereby an electrical connection is achieved between the conductor elements 21 which consist of metal. As a result, a signal may be triggered whereby, for example, a drive, not shown, of a closing device of the rear hood 1 may be activated, so that the user may open the rear hood 1 of the motor vehicle.

In the present exemplary embodiment, the actuation part 10 and the housing part 20 are connected by a material connection to one another on their peripheral edge regions 10*a*, 20*a*, which means laser-welded in the present exemplary embodiment. As a result the internal space 2, which is defined by the actuation part 10 and the housing part 20, is entirely sealed off from the environment 3. As a result, possible environmental influences are prevented from interfering with the operation of the electronics which are provided inside the internal space 2. The actuation part 10 in the present exemplary embodiment is designed as a type of rocker, which is pivotably mounted about an axis 4. In the present exemplary embodiment, the axis 4 extends axially symmetrically relative to the internal space 2 which means that, irrespective of the pivoted position of the actuation part 10, the volume of the internal space 2 is almost constant. As indicated in FIG. 1, the axis 4 extends within the internal space 2. It is also conceivable that in a further variant, not shown, the axis 4 extends outside the internal space 2.

The rotational mounting of the actuation part 10 on the housing part 20 takes place via latching means 16, 26 corresponding to one another, which are located in the internal space 2 and are connected together. The first latching means 26 of the housing part 20 is of shell-like configuration, into which the second latching means 16 of the actuation part 10 is rotatably received. The second latching means 16 is configured as a type of bearing body which is retained positively on the first latching means 26, in the mounted state of the actuation unit the second latching means 16 being mounted rotatably on the first latching means 26, so that the actuation part 10 may be reliably pivoted about the axis 4.

The housing part 20 according to FIG. 2 is configured with a contoured body 24 on which the conductor elements 21 and the contact element 22 are at least partially arranged. For reliable fastening of the contact element 22 a retaining element 23 is provided which, according to FIG. 6, is fastened to the contoured body 24. The contoured body 24 has in this case cylindrical fixing elements 27 to which the retaining element 23 is fastened. The retaining element 23 is designed with a through-opening 29 so that the contact element 22 may be reliably brought into contact with the plunger 11. As is illustrated particularly in FIG. 6 and FIG. 8, the retaining element 23 has two fastening regions 33 with in each case one opening 35 through which the cylindrical fixing element 27 of the housing part 20 protrudes. Moreover, the fastening region 33 in the region of the opening 35 is designed with a wing element 34 which acts on the fixing element 27. In this case, the wing element 34 is aligned obliquely to the fixing element 27, whereby the retaining element 23 is effectively prevented from being released from the contoured body 24 and/or from the housing part 20 by possibly occurring forces originating from the contact element 22.

As may be seen in FIG. 2 and in FIG. 4 to FIG. 6, the housing part 20 has channels 25 which are open on one side, in which in each case a conductor element 21 is located. During the mounting of the actuation unit, initially the conductor elements 21 are inserted into the open channels 25, and the conductor elements 21 extend in the direction of a sleeve element 31 of the housing part 20 which is also shown in FIG. 7. In this case, the free ends 21*a* of the conductor elements 21 according to FIG. 3 terminate in the sleeve element 31, which serves as a plug. The actuation unit may be electrically connected via the plug to further electric components on the motor vehicle. So that the conductor element 21 may not be inadvertently pulled from the actuation unit, out of the internal space 2, by a tensile force on the sleeve element 31, the conductor element 21 is designed with a projection-like stop means 28 according to FIG. 3. Said stop means 28 in the present exemplary embodiment is configured in a wedge-shaped manner and forms with its front face, which is oriented toward the free end 21*a* of the conductor element 21, an effective stop surface which bears against the housing part material according to FIG. 4. As is shown explicitly in FIG. 3, the conductor element 21 is at least partially configured with a toothed portion 30 which acts according to FIG. 4 on the housing part material, so that a reliable fixing of the conductor element 21 may be achieved inside the internal space 2. The teeth 30 are oriented in the direction of the contact element 22 so that, when mounting the actuation unit, the conductor element 21 is prevented from falling out in the opposite direction to the sleeve element 31.

After the conductor elements 21 are inserted in a first mounting step in the channels 25 which serve as guide tracks, the contact element 22 is positioned on the contoured body 24 and on the conductor elements 21, which is shown explicitly in FIG. 5. The contact element 22 has in this case four bearing points 22*a*. The two left-hand bearing points 22*a* according to FIG. 5 come into contact in this case with the left-hand conductor element 21. The right-hand bearing points 22*a* bear against the contoured body 24 of the housing part 20. The right-hand conductor element 21 extends below the contact element 22 and does not come into contact with the contact element 22 in the non-actuated state of the actuation part 10. Only when the contact element 22 is deformed in the direction of the conductor elements 21 via the plunger 11 according to FIG. 1, is contact produced between the contact element 22 and the right-hand conductor element 21, so that an electrical connection is produced between the adjacent conductor elements 21.

So that the contact element 22 may be reliably positioned during mounting on the housing part 20, the housing part 20, in particular the contoured body 24, has at various points retaining regions 32 which are shown both in FIG. 4 and in FIG. 5. Said retaining regions 32 are partially adapted to the contour of the contact element 22, and also serve amongst other things as a stop element for improved alignment of the contact element 22 on the housing part 20. As FIG. 4 illustrates, the channels 25 extend toward the contoured body 24.

The interior of the actuation unit is preferably mounted via a mechanical mounting device which means that both the conductor elements 21, the contact element 22 and the retaining element 23 are automatically mounted on the actuation unit. As indicated in FIG. 4, the channels 25 are further designed with a groove-shaped free space 36 for the mounting device. The actuation part 10 represents a two-component injection-molded part made of plastics material. In this case, the actuation part 10 of FIG. 1 and FIG. 2 is designed with a hard component, which is shown in gray. The edge region 10*a* and a connecting web 10*b* of the actuation arrow 10 according to FIG. 1 are made from a flexible component, the plunger 11 also consisting of the aforementioned flexible component. The latching means 16, however, are made from the hard component. The regions of the conductor elements 21 which are located below the contact element 22 are in the present exemplary embodiment surface-finished, in particular have a gold coating. As a result, the possibility of corrosion occurring on those regions of the conductor elements 21 is prevented.

In FIG. 9 and FIG. 10 a further variant is shown of the actuation unit shown in FIGS. 1 to 8. In contrast to the exemplary embodiments according to FIG. 1 to FIG. 8, in which a retaining element 23 is provided for reliable fixing of the contact element 22, the contact element 22 according to FIG. 9 and FIG. 10 is designed so that a retaining element 23 may be dispensed with. In this case, the contact element 22 is designed with a fastening portion 43 according to FIG. 9, which is configured with an opening 49 through which the fixing element 27 of the contoured body 24 and/or of the housing part 20 protrudes according to the exemplary embodiments of FIG. 1 to FIG. 8.

The fastening portion 43 in the region of the opening 45 is designed with two wing elements 44, which in each case act on the fixing element 27. The wing elements 44 are aligned obliquely to the fixing element 27, whereby a reliable fastening of the contact element 22 to the housing part 20 is ensured. With an activation of the actuation part 10 by the user, the plunger 11 acts according to FIG. 1 in the direction of the contact element 22 according to FIG. 9, which is deformed in the direction of the conductor elements 21, so that an electrical connection is produced between the adjacent conductor elements 21. As shown in FIG. 9, the conductor elements 21 are designed with a toothed portion 30, a stop means 28 and a free end 21*a*, as in FIG. 3. The mounting of the conductor elements 21 takes place as in the exemplary embodiments according to FIG. 1 to FIG. 8, which are already described above.

FIG. 10 has a further variant of the contact element 22 which, as in FIG. 9, is directly fastened to the housing part 20 without a retaining element. The contact element 22 is designed according to FIG. 10 with two fastening portions 43, each fastening portion corresponding to the fastening portion 43 of the exemplary embodiment according to FIG. 9. This means that the fastening portion 43 of FIG. 10 is fastened via its wing elements 44 to the fixing element 27 of the housing part 20 on both its sides. Located between the two fastening portions 43 is the surface portion on which the plunger 11 of FIG. 1 acts. If the actuation part is actuated by the user, the plunger 11 of FIG. 1 deforms the contact element 22 to such an extent that an electrical connection is produced between the adjacent conductor elements 21. In the present exemplary embodiment, the conductor elements 21 are cylindrical, i.e. designed to be circular in their cross section. The free end 21*a* of each conductor element 21 in the present exemplary embodiment is of rectangular configuration. Naturally, the conductor elements 21 according to FIG. 10 may be replaced by the conductor elements according to FIG. 3 and/or FIG. 9 and vice versa.

The contact element 22 according to FIG. 9 has, moreover, two support elements 46 which bear on the contoured body 24 of the housing part 20. The advantage of the exemplary embodiment according to FIG. 9 and FIG. 10 is that the contact element 22 is integrally connected to its fastening portion 43, and is of the same material, whereby a reliable fastening of the contact element above the conductor elements 21 may be achieved in a simple structural manner.

LIST OF REFERENCE NUMERALS

1 Movable part, rear hood
2 Internal space
3 Environment
4 Axis
10 Actuation part
10*a* Edge region of actuation part 10
10*b* Connecting web of actuation part 10
11 Plunger
16 Latching means, second latching means
20 Housing part
20*a* Edge region of housing part 20
21 Conductor element
21*a* Free end of conductor element 21
22 Contact element, snap disk
22*a* Bearing point of contact element 22
23 Retaining element
24 Contoured body of housing part 20
25 Channel open on one side, guide track
26 Latching means, first latching means
27 Fixing element of contoured body 24
28 Stop means of conductor element 21
29 Through-opening of retaining element 23
30 Toothed portion of conductor element 21
31 Sleeve element
32 Retaining region of contoured body 24
33 Fastening region of retaining element 23
34 Wing element of fastening region 33
35 Opening of retaining element 23
36 Free space of channel 25
43 Fastening portion of 22
44 Wing element of 22
45 Opening of 22
46 Support element of 22

The invention claimed is:

1. An actuation unit of a movable part (1) of a motor vehicle, comprising an actuation part (10) which is fastened to a housing part (20), at least two conductor elements (21) which are arranged on the housing part (20), an elastically deformable contact element (22) which cooperates with the conductor elements (21), and a plunger (11) which is arranged on the actuation part (10) for deforming the contact element (22), wherein the actuation part (10) and the housing part (20) define an internal space (2) which is entirely sealed off from the environment (3) and the actuation part (10) is pivotably mounted about an axis (4) which extends axially symmetrically relative to the internal space (2);

wherein a retaining element (23) is fastened to the housing part (20) such that at the same time the contact element (22) is held reliably in position;

characterized in that the housing part (20) comprises a contoured body (24) to which the retaining element (23) or the contact element (22) is fastened.

2. The actuation unit as claimed in claim 1, characterized in that the actuation part (10) and the housing part (20) are connected together by a material connection on their peripheral edge regions (10*a*, 20*a*).

3. The actuation unit as claimed in claim 1, characterized in that the axis (4) extends inside the internal space (2).

4. The actuation unit as claimed in claim 1, characterized in that the housing part (20) is configured with channels (25) which are open on one side, in which one respective conductor element (21) extends.

5. The actuation unit as claimed in claim 1, characterized in that the contoured body (24) is designed with at least one fixing element (27) to which the retaining element (23) or the contact element (22) is fastened.

6. The actuation unit as claimed in claim 5, characterized in that the retaining element (23) comprises at least one fastening region (33) with one respective opening (35), through which one respective fixing element (27) protrudes.

7. The actuation unit as claimed in claim 6, characterized in that the fastening region (33) in the region of the opening (35) is designed with a wing element (34) which acts on the fixing element (27), in particular is aligned obliquely to the fixing element (27), whereby a reliable fastening of the retaining element (23) to the housing part (20) is ensured.

8. The actuation unit as claimed in claim 5, characterized in that the contact element (22) is designed with at least one fastening portion (43) with one respective opening (45), through which the fixing element (27) protrudes.

9. The actuation unit as claimed in claim 8, characterized in that the fastening portion (43) in the region of the opening (45) is designed with a wing element (44) which acts on the fixing element (27), in particular is aligned obliquely to the fixing element (27), whereby a reliable fastening of the contact element (22) to the housing part (20) is ensured.

10. The actuation unit as claimed in claim 1, characterized in that the conductor element (21) is designed at least partially with a surface which is of tooth-like (30) configuration and which acts on the housing part (20), whereby a reliable fixing of the conductor element (21) inside the internal space (2) may be achieved.

11. The actuation unit as claimed in claim 1, characterized in that the conductor element (21) has at least one projection-like stop means (28), which prevents inadvertent removal of the conductor element (21) from the internal space (2).

12. The actuation unit as claimed in claim 1, characterized in that the retaining element (23) has a through-opening (29), so that the contact element (22) may be brought into contact with the plunger (11).

13. The actuation unit as claimed in claim 1, characterized in that the actuation part (10) is a multi-component injection-molded part made of plastics material.

14. The actuation unit as claimed in claim 13, characterized in that the actuation part (10) consists of a hard component and a flexible component, an edge region (10*a*) of the actuation part (10), which is fastened to an edge region (20*a*) of the housing part (20), and the plunger (11) consisting of the flexible component, and a latching means (16) of the actuation part (10) consisting of the hard component.

15. The actuation unit as claimed in claim 14, characterized in that the mechanical resistance W of the flexible component is between 30 Shore-A≤W≤70 Shore-A.

16. The actuation unit as claimed in claim 1, characterized in that the housing part (20) has a sleeve element (31) in which the conductor elements (21) terminate.

17. The actuation unit as claimed in claim 1, characterized in that the contoured body (24) comprises retaining regions (32) to which the contact element (21) is positively fastened.

18. An actuation unit of a movable part (1) of a motor vehicle, comprising an actuation part (10) which is fastened to a housing part (20), at least two conductor elements (21) which are arranged on the housing part (20), an elastically deformable contact element (22) which cooperates with the conductor elements (21), and a plunger (11) which is arranged on the actuation part (10) for deforming the contact element (22), wherein the actuation part (10) and the housing part (20) define an internal space (2) which is entirely sealed off from the environment (3) and the actuation part (10) is pivotably mounted about an axis (4) which extends axially symmetrically relative to the internal space (2);

characterized in that the actuation part (10) and the housing part (20) have a first latching means (26) and a second latching means (16) corresponding to one another, which are located in the internal space (2) and are connected together.

19. The actuation unit as claimed in claim 18, characterized in that the first latching means (26) is of shell-like configuration and the second latching means (16), which is designed as corresponding counterlatching means, is held by the first latching means (26).

20. The actuation unit as claimed in claim 19, characterized in that the second latching means (16) has a bearing body which is positively held on the first latching means (26), the second latching means (16) being rotatably mounted on the first latching means (26), so that the actuation part (10) is pivotable.

21. The actuation unit as claimed in claim 19, characterized in that the axis (4) extends through the first (26) and the second latching means (16).

* * * * *